US011408300B2

(12) United States Patent
Merry et al.

(10) Patent No.: US 11,408,300 B2
(45) Date of Patent: Aug. 9, 2022

(54) ROTOR OVERSPEED PROTECTION ASSEMBLY

(71) Applicant: UNITED TECHNOLOGIES CORPORATION, Farmington, CT (US)

(72) Inventors: Brian Merry, Andover, CT (US); Paul W. Duesler, Manchester, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 919 days.

(21) Appl. No.: 16/207,669

(22) Filed: Dec. 3, 2018

(65) Prior Publication Data

US 2020/0173297 A1 Jun. 4, 2020

(51) Int. Cl.

| | |
|---|---|
| ***F01D 11/08*** | (2006.01) |
| ***F01D 21/04*** | (2006.01) |
| ***F01D 21/02*** | (2006.01) |

(52) U.S. Cl.

CPC ..... *F01D 11/08* (2013.01); *F01D 21/045* (2013.01); *F01D 21/02* (2013.01); *F01D 21/04* (2013.01); *F05D 2240/11* (2013.01); *F05D 2270/09* (2013.01)

(58) Field of Classification Search

CPC ..... F01D 11/08; F01D 21/02; F01D 21/04; F01D 21/045; F05D 2240/11; F05D 2270/09

See application file for complete search history.

(56) References Cited

U.S. PATENT DOCUMENTS

| | | | | |
|---|---|---|---|---|
| 4,505,104 | A | 3/1985 | Simmons | |
| 6,729,842 | B2 | 5/2004 | Drerup et al. | |
| 9,617,863 | B2 | 4/2017 | Mahle et al. | |
| 2014/0341707 | A1* | 11/2014 | Jones | F01D 11/24 415/1 |
| 2017/0101882 | A1 | 4/2017 | Sippel et al. | |

FOREIGN PATENT DOCUMENTS

| | | |
|---|---|---|
| EP | 2009251 | 12/2008 |
| EP | 2631434 | 8/2013 |
| EP | 3249169 | 11/2017 |

OTHER PUBLICATIONS

European Patent Office, European Search Report dated Mar. 6, 2020 in Application No. 19201140.1.

* cited by examiner

*Primary Examiner* — Michael Lebentritt
*Assistant Examiner* — Julian B Getachew
(74) *Attorney, Agent, or Firm* — Snell & Wilmer L.L.P.

(57) ABSTRACT

A gas turbine engine may include a rotor overspeed protection (ROP) assembly. The ROP assembly may include an annular blade outer air seal (BOAS) assembly including a ROP segment. The ROP assembly may include a stator vane coupled with the BOAS assembly/. The stator vane may include a stator flange disposed about a forward edge portion of the stator vane. The ROP segment may include a ROP flange extending in an axially aft direction from a main body of the ROP segment toward the stator vane, wherein the ROP flange is disposed radially inward of the stator flange.

18 Claims, 9 Drawing Sheets

ROTOR OVERSPEED PROTECTION ASSEMBLY

GOVERNMENT LICENSE RIGHTS

This invention was made with Government support awarded by the United States. The Government has certain rights in this invention.

FIELD

The present disclosure relates to gas turbine engines, and, more specifically, to a blade outer air seal of a turbine section or a compressor section.

BACKGROUND

A gas turbine engine may include a fan section, a compressor section, a combustor section, and a turbine section. A turbine in-use may become unstable and reach high speeds upon the occurrence of a high shaft failing. The turbine may be prevented from reaching excessive speeds using a combination of compressor surge, blade and vane airfoil intermeshing, fuel shutoff, or frictional braking from metal to metal contact of rotating and static hardware. However, if blade and vane intermeshing or fuel shutoff are not viable options, rotor overspeed should be otherwise sufficiently prevented or controlled.

SUMMARY

In various embodiments, a rotor overspeed protection (ROP) assembly of a gas turbine engine is provided. In various embodiments, the ROP assembly may comprise an annular blade outer air seal (BOAS) assembly comprising a ROP segment. In various embodiments, the ROP assembly may comprise a stator vane coupled with the BOAS assembly, the stator vane comprising a stator flange disposed about a forward edge portion of the stator vane. In various embodiments, the ROP segment comprises a ROP flange extending in an axially aft direction from a main body of the ROP segment toward the stator vane, wherein the ROP flange is disposed radially inward of the stator flange. In various embodiments, the BOAS assembly comprises a BOAS segment coupled with the ROP segment, the BOAS segment comprising a BOAS flange extending in an axially aft direction from a main body of the BOAS segment toward the stator vane, wherein the BOAS flange is disposed radially outward of the stator flange of the stator vane. In various embodiments, the ROP segment is coupled to a second ROP segment. In various embodiments, the second ROP segment disposed about 180 degrees from the ROP segment about the BOAS assembly. In various embodiments, the BOAS assembly comprises a plurality of ROP segments and a plurality of BOAS segments, wherein the plurality of ROP segments and the plurality of BOAS segments alternate about the BOAS assembly. In various embodiments, the BOAS assembly comprises a plurality of ROP segments disposed about 90 degrees apart about the BOAS assembly. In various embodiments, the stator flange is configured to contact the ROP flange in response to the stator vane rotating about a rear leg of the stator vane in an aft direction. In various embodiments, the BOAS assembly is comprised entirely of ROP segments.

In various embodiments, a gas turbine engine is provided. In various embodiments, the gas turbine engine may comprise a turbine section or a compressor section including a stator vane. In various embodiments, the gas turbine engine may comprise an annular blade outer air seal (BOAS) assembly comprising a ROP segment. In various embodiments, the gas turbine engine may comprise a stator vane coupled with the BOAS assembly, the stator vane comprising a stator flange disposed about a forward edge portion of the stator vane. In various embodiments, the gas turbine engine comprises a ROP flange extending in an axially aft direction from a main body of the ROP segment toward the stator vane, wherein the ROP flange is disposed radially inward of the stator flange. In various embodiments, the BOAS assembly comprises a BOAS segment coupled with the ROP segment, the BOAS segment comprising a BOAS flange extending in an axially aft direction from a main body of the BOAS segment toward the stator vane, wherein the BOAS flange is disposed radially outward of the stator flange of the stator vane. In various embodiments, the ROP segment is coupled to a second ROP segment. In various embodiments, the second ROP segment disposed about 180 degrees from the ROP segment about the BOAS assembly. In various embodiments, the BOAS assembly comprises a plurality of ROP segments and a plurality of BOAS segments, wherein the plurality of ROP segments and the plurality of BOAS segments alternate about the BOAS assembly. In various embodiments, the BOAS assembly comprises a plurality of ROP segments disposed about 90 degrees apart about the BOAS assembly. In various embodiments, the stator flange is configured to contact the ROP flange in response to the stator vane rotating about a rear leg of the stator vane in an aft direction. In various embodiments, the BOAS assembly is comprised entirely of ROP segments.

In various embodiments, a method of manufacturing a ROP assembly is provided. The method may comprise manufacturing a blade outer air seal (BOAS) assembly, wherein the BOAS assembly comprises a ROP segment. The method may comprise coupling a stator vane with the ROP segment, wherein the ROP segment comprises a ROP flange extending in an axially aft direction from a main body of the ROP segment toward the stator vane, wherein the ROP flange is disposed radially inward of a stator flange of the stator vane. The method may comprise coupling the BOAS assembly with an engine case structure of a gas turbine engine. The manufacturing the BOAS assembly may comprise coupling a first ROP segment to a first BOAS segment. The manufacturing the BOAS assembly may comprise coupling a first ROP segment to a second ROP segment.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact. Cross hatching lines may be used throughout the figures to denote different parts but not necessarily to denote the same or different materials.

As used herein, "aft" refers to the direction associated with the tail (e.g., the back end) of an aircraft, or generally, to the direction of exhaust of the gas turbine engine. As used herein, "forward" refers to the direction associated with the nose (e.g., the front end) of an aircraft, or generally, to the direction of flight or motion.

As used herein, "distal" refers to the direction radially outward, or generally, away from the axis of rotation of a turbine engine. As used herein, "proximal" refers to a direction radially inward, or generally, towards the axis of rotation of a turbine engine.

Figure 1:
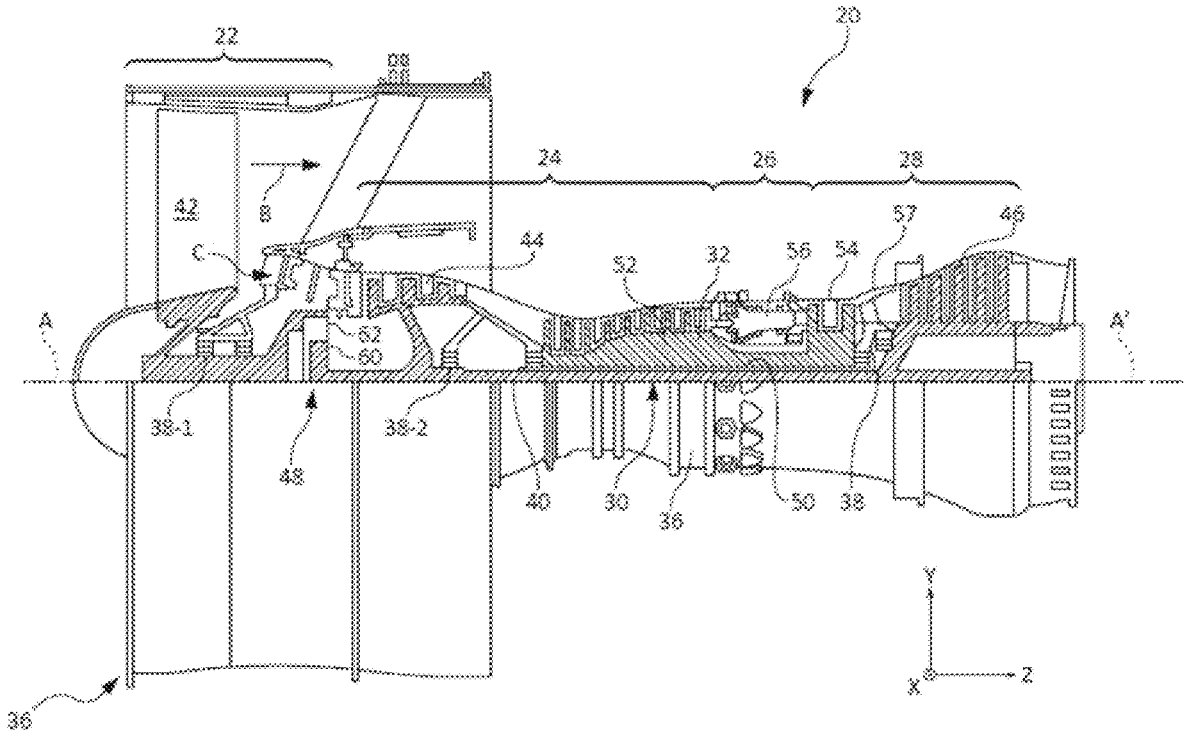
FIG. 1 illustrates a cross-sectional view of an exemplary gas turbine engine, in accordance with various embodiments.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. In operation, fan section 22 can drive fluid (e.g., air) along a bypass flow-path B while compressor section 24 can drive fluid along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of turbine engines including three-spool architectures, as well as industrial gas turbines.

Gas turbine engine 20 may generally comprise a low speed spool 30 and a high speed spool 32 mounted for rotation about an engine central longitudinal axis A-A' relative to an engine case structure 36 via several bearing systems 38, 38-1, and 38-2. Engine central longitudinal axis A-A' is oriented in the z direction on the provided xyz axis. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor 44 and a low pressure turbine 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54. A combustor 56 may be located between high pressure compressor 52 and high pressure turbine 54. A mid-turbine frame 57 of engine case structure 36 may be located generally between high pressure turbine 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

Gas turbine engine 20 may be, for example, a high-bypass ratio geared aircraft engine. In various embodiments, the bypass ratio of gas turbine engine 20 may be greater than about six (6). In various embodiments, the bypass ratio of gas turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans. A gas turbine engine may comprise an industrial gas turbine (IGT) or a geared aircraft engine, such as a geared turbofan, or non-geared aircraft engine, such as a turbofan, or may comprise any gas turbine engine as desired.

Figure 2:
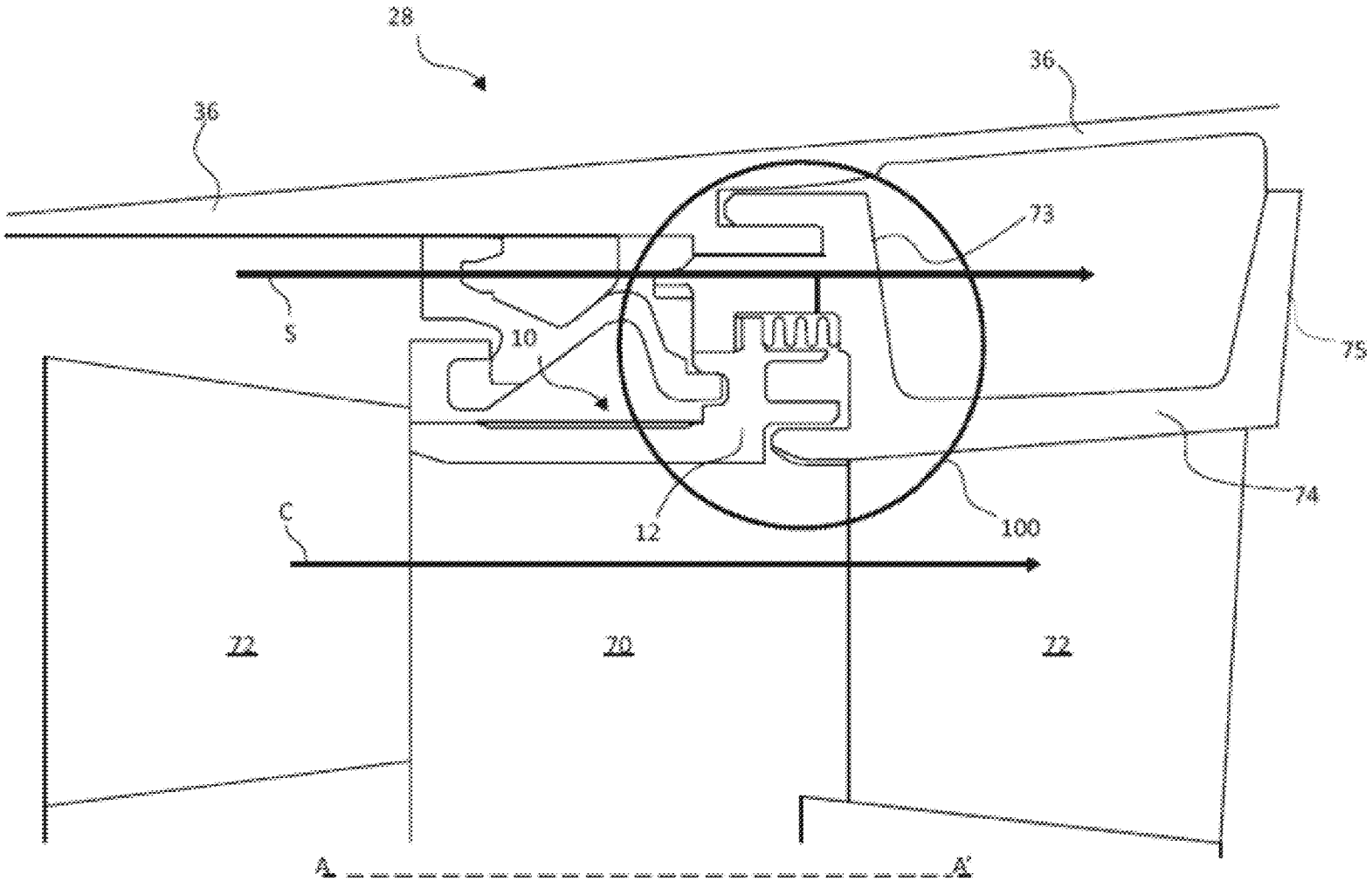
FIG. 2 illustrates a schematic cross-section of a portion of a high pressure turbine section of the gas turbine engine of FIG. 1, in accordance with various embodiments.

Still referring to FIG. 1 and now to FIG. 2, according to various embodiments, each of low pressure compressor 44, high pressure compressor 52, low pressure turbine 46, and high pressure turbine 54 in gas turbine engine 20 may comprise one or more stages or sets of rotating blades ("rotors blades") and one or more stages or sets of stationary vanes ("stator vanes") axially interspersed with the associated blade stages but non-rotating about engine central longitudinal axis A-A'. The low pressure compressor 44 and high pressure compressor 52 may each comprise one or more compressor stages. The low pressure turbine 46 and high pressure turbine 54 may each comprise one or more turbine stages. Each compressor stage and turbine stage may comprise multiple interspersed stages of rotor blades 70 and stator vane 72. The rotor blades 70 rotate about engine central longitudinal axis A-A' with the associated shaft 40 or 50 while the stator vane 72 remains stationary about engine central longitudinal axis A-A'. For example, FIG. 2 schematically shows, by example, a turbine stage of turbine section 28 of gas turbine engine 20. Unless otherwise indicated, the term "blade stage" refers to at least one of a turbine stage or a compressor stage. The compressor and turbine sections 24, 28 may comprise rotor-stator assemblies.

Figure 4:
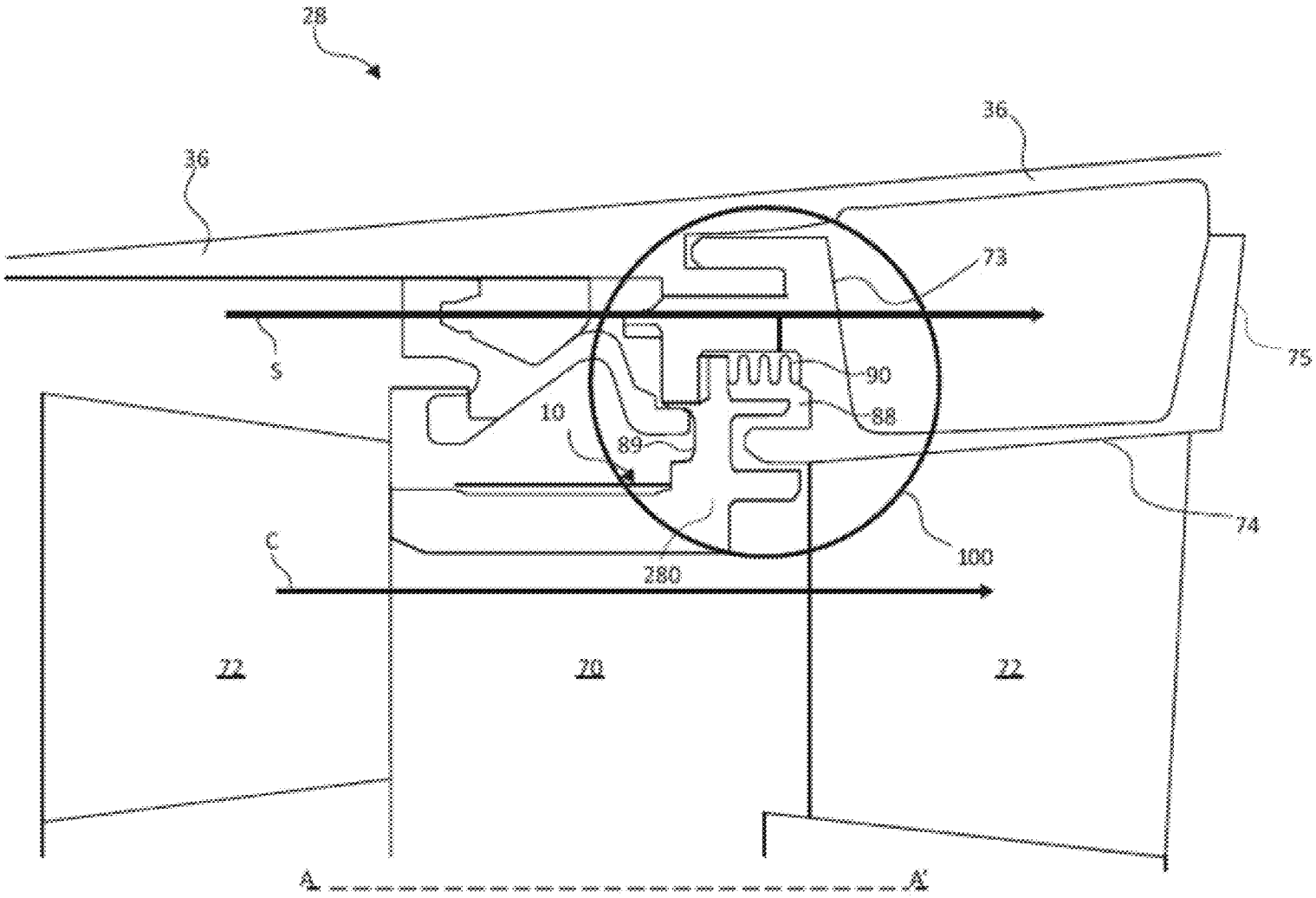
FIG. 4 illustrates a schematic cross-section of a portion of a high pressure turbine section of the gas turbine engine of FIG. 1, in accordance with various embodiments.

With reference to FIGS. 2 and 4, a portion of turbine section 28 is illustrated, in accordance with various embodiments. Rotor blade 70 may be, for example, a turbine rotor including a circumferential array of blades configured to be connected to and rotate with a rotor disc about engine central longitudinal axis A-A'. Upstream (forward) and downstream (aft) of rotor blade 70 are stator vane 72, which may be, for example, turbine stators including circumferential arrays of vanes configured to guide core airflow C flow through successive turbine stages, such as through rotor blade 70. A radially outer portion 74 of stator vane 72 may be coupled to engine case structure 36.

In various situations, a turbine in use may reach high speeds and may become unstable upon the occurrence of a high shaft failing. Specifically, when a high shaft fails, high pressure turbine 54 may slide aft along gas turbine engine 20 due to a pressure differential between a forward side and an aft side of the high pressure turbine 54. High pressure turbine 54 may slide in an aft direction along gas turbine engine 20 with thousands of pounds of force. The rotor blade 70 of high pressure turbine 54 may contact stator vane 72, causing a portion of forward end 73 of stator vane 72 to break or otherwise fail. Stator vane 72 may in turn rotate aft about a rear leg 75 and cause damage to a further aft portion of gas turbine engine 20. The stator flange 78 may then contact ROP flange 286 of ROP segments 280 and pull ROP flange 286 radially inward. As ROP flange 286 is pulled radially inward, rear BOAS leg 89 (shown on FIGS. 4 and 5) may break or fracture and main body 282 of ROP segment 280 may contact rotor blade 70 and diminish the torque and speed of the rotor blade 70. In this way, ROP segment 280 may damage or potentially break rotor blade 70, and reduce or prevent overspeed of rotor blade 70. In various embodiments, multiple ROP segments (for example **280*a*-280*e*) may be arranged in BOAS assembly 10 such that overspeed of rotor blade 70** is diminished or prevented.

According to various embodiments, and referring to FIGS. 2 and 4, compressor and turbine rotors may comprise a rotor overspeed protection (ROP) assembly 100. According to various embodiments, ROP assembly 100 may comprise a stationary annular fluid seal, referred to as a blade outer air seal (BOAS) assembly 10, circumscribing the rotor blades 70 to contain and direct core airflow C. Referring to FIG. 2, BOAS assembly 10 may include one or more of BOAS segment 12 circumferentially arranged to form a ring about engine central longitudinal axis A-A' radially outward of rotor blades 70. Although only one of BOAS segment 12 is shown in FIG. 2, turbine section 28 may comprise an associated array of BOAS segment 12. BOAS assembly 10 may be disposed radially outward of a rotor blade 70 or a plurality of rotor blades 70 relative to engine central longitudinal axis A-A'. Each BOAS segment 12 may couple to an adjacent BOAS segment 12 to form the annular BOAS assembly 10. Each BOAS segment 12 may further couple to engine case structure 36.

In various embodiments, ROP assembly 100 may comprise stator vane 72 coupled to axially adjacent BOAS segment 12. FIG. 2 shows an area within turbine section 28 that includes BOAS segment 12 disposed between a forward and an aft stator vane 72. During engine operation, stator vane 72 and BOAS segment 12 may be subjected to different thermal loads and environmental conditions. Cooling air may be provided to BOAS segment 12 and stator vane 72 to enable operation of the turbine during exposure to hot combustion gasses produced within the combustion area, as described above. Referring momentarily to FIG. 1, pressurized air may be diverted from combustor section 26 or compressor section 24 and used to cool components within the turbine section 28.

Referring back to FIG. 2, BOAS assembly 10 and stator vane 72 may be in fluid communication with a secondary airflow source, such as an upstream compressor in the compressor section 24 or other source, which provides cooling airflow, such as bleed compressor air. BOAS segment 12 and stator vane 72 may be coupled to engine case structure 36 and may define a secondary airflow path S between engine case structure 36 and BOAS segment 12. A secondary airflow S is shown flowing axially downstream between engine case structure 36 and radially outer portion 74 of stator vane 72. Secondary airflow S provides varying levels of cooling to different areas of BOAS segment 12 around blades 70.

Figure 3:
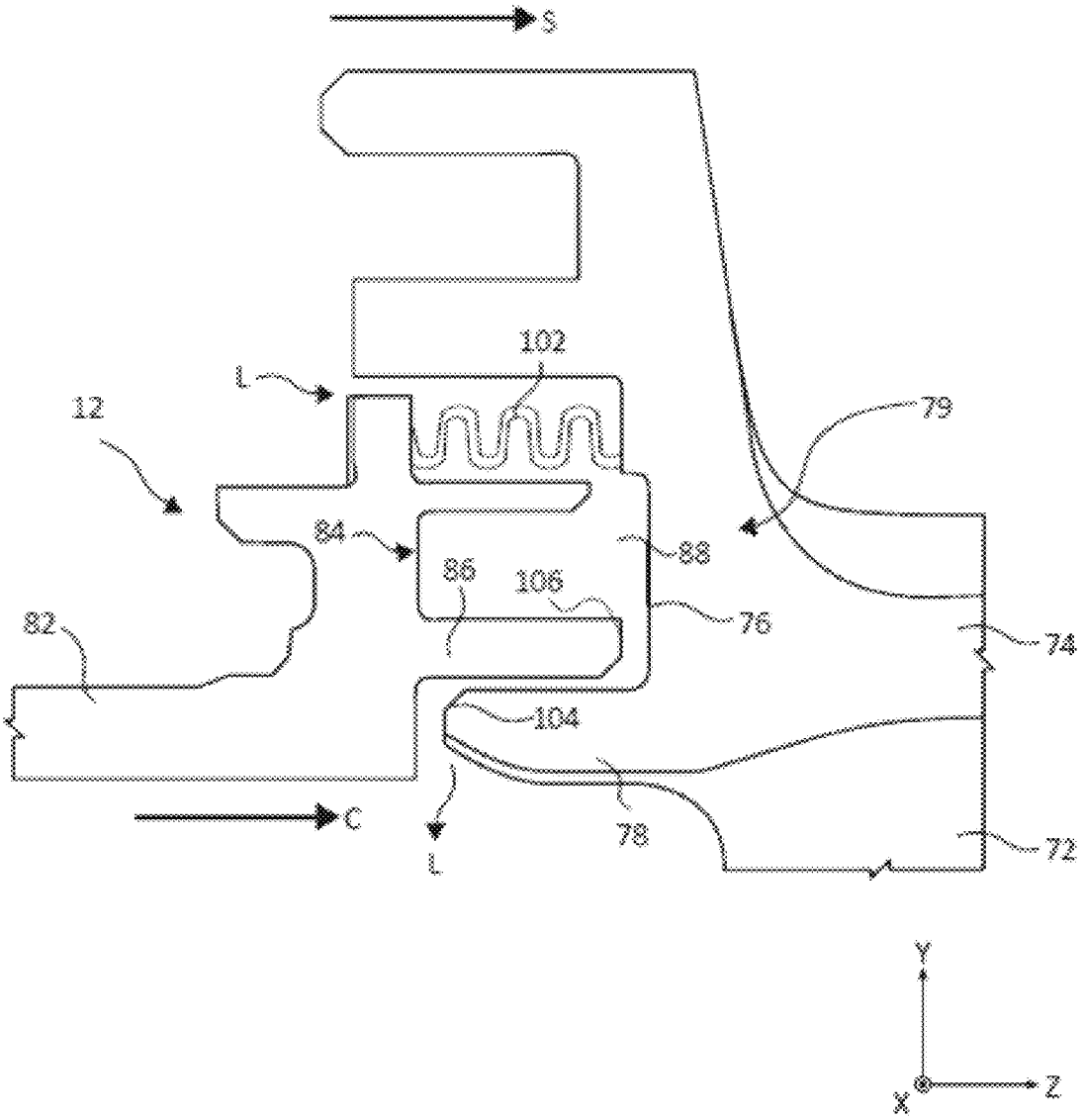
FIG. 3 illustrates a cross-sectional view of a rotor overspeed protection assembly, in accordance with various embodiments.

Referring to FIG. 3, an axial separation may exist between BOAS segment 12 and stator vane 72. For example, stator vane 72 may be axially separated from BOAS segment 12 by a distance or gap 88. Gap 88 may expand and contract (axially and/or radially) in response to the thermal or mechanical environment. In addition, gap 88 may expand and/or contract (axially and/or radially) as a result of thermal, mechanical, and pressure loading imparted in BOAS segment 12, stator vane 72, or supporting structure during various transient and steady state engine operating conditions.

In various embodiments, gap 88 may be configured to house a seal 102. Cooling air from secondary airflow S may tend to leak between BOAS segment 12 and stator vane 72 in response to a pressure differential. Thus, a seal 102 may be disposed between BOAS segment 12 and stator vane 72 to prevent, reduce, and/or control leakage of secondary airflow S through gap 88 into core airflow path C.

Figure 5:
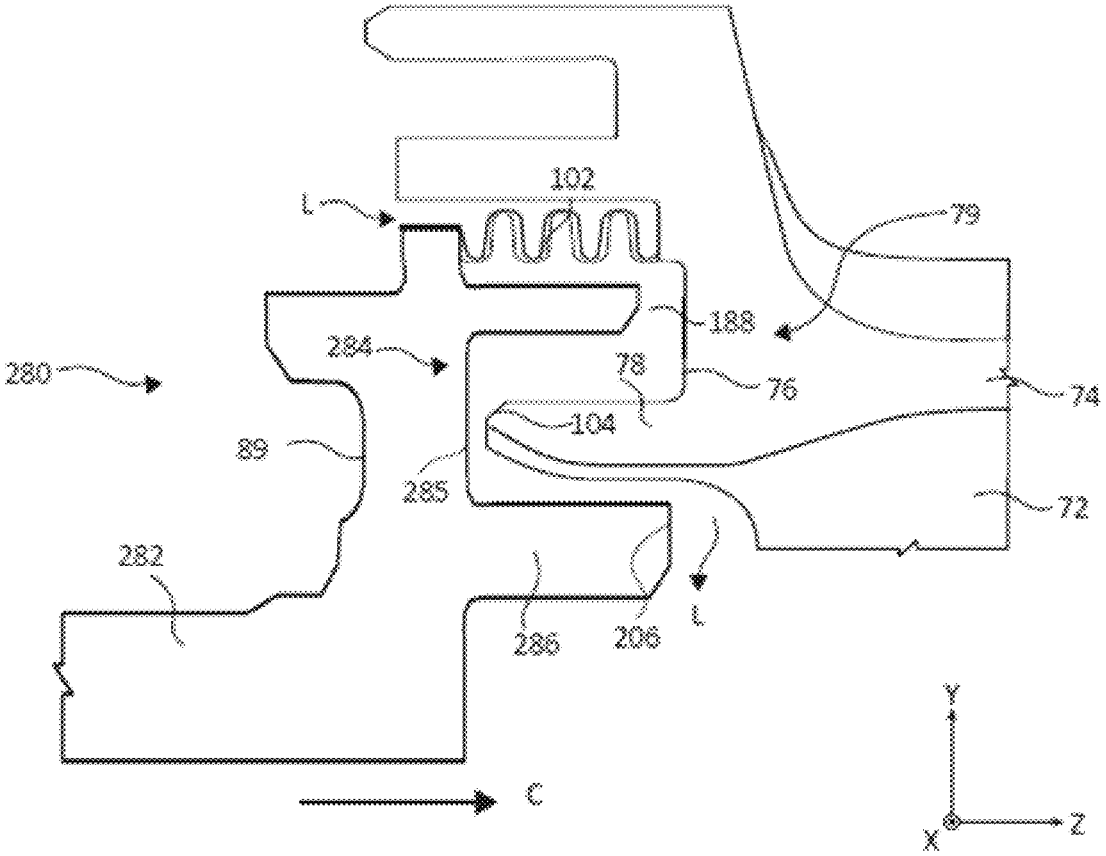
FIG. 5 illustrates a cross-sectional view of a rotor overspeed protection assembly, in accordance with various embodiments.

According to various embodiments, and with reference to FIGS. 3 and 5, stator vane 72 may comprise stator flange 78 disposed at or near a forward edge portion 79 of stator vane 72. Stator flange 78 may axially terminate at stator flange wall 104.

According to various embodiments, and with reference to FIG. 3, BOAS segment 12 may comprise a main body 82 that extends generally axially from a forward portion to an aft portion 84. BOAS segment 12 may also include BOAS flange 86 disposed at or near the aft portion 84. BOAS flange 86 may extend in an axially aft direction from main body 82 toward stator vane 72. Aft portion 284 of BOAS segment 12 and forward edge portion 79 of stator vane 72 interface to form gap 88. BOAS flange 86 may, in various embodiments, extend in an axially forward direction, or in an x direction or y direction. Axially extending flange 86 of BOAS segment 12 may correspond to a receiving portion 76 of stator vane 72 to support and attach BOAS segment 12. BOAS flange 86 may axially terminate at BOAS flange wall 106. BOAS segment 12 may further be configured to receive stator flange 78 of stator vane 72. In various embodiments, BOAS flange 86 of BOAS segment 12 may be disposed radially outward (a positive y-direction) of stator flange 78 of stator vane 72.

In various embodiments, and with reference to FIGS. 4 and 5, BOAS assembly 10 may comprise at least one ROP segment 280. Referring momentarily to FIG. 6, ROP segment 280 may couple to an adjacent BOAS segment 12 or an adjacent ROP segment 280 to form the annular BOAS assembly 10. Referring to FIG. 4, according to various embodiments, ROP segment 280 may be coupled to axially adjacent stator vane 72. Turbine section 28 may include ROP segment 280 disposed between a forward and an aft stator vane 72. ROP segment 280 and stator vane 72 may be coupled to engine case structure 36 and may define a secondary airflow path S between engine case structure 36 and ROP segment 280.

Referring to FIG. 5, according to various embodiments, ROP segment 280 may comprise a main body 282 that extends generally axially from a forward portion to an aft portion 284. ROP segment 280 may comprise at least one ROP flange 286 disposed at or near the aft portion 284. ROP flange 286 may extend in an axially aft direction from main body 282 toward stator vane 72. ROP flange 286 may alternatively extend in an axially forward direction, or in an x direction or y direction. ROP flange 286 may axially terminate at ROP flange wall 206. ROP segment 280 may further be configured to receive stator flange 78 of stator vane 72. Stator flange wall 104 may correspond to receiving portion 285 of ROP segment 280 to support and attach ROP segment 280. Aft portion 284 of ROP segment 280 and forward edge portion 79 of stator vane 72 interface to form gap 88. In various embodiments, ROP flange 286 of ROP segment 280 may be disposed radially inward (in the negative y-direction) of stator flange 78 of stator vane 72.

During engine operation, stator vane 72 and ROP segment 280 may be subjected to different thermal loads and environmental conditions. Cooling air may be provided to ROP segment 280 and stator vane 72 to enable operation of the turbine during exposure to hot combustion gasses produced within the combustion area. Secondary airflow S provides varying levels of cooling to different areas of ROP segment 280 around blades 70.

Stator vane 72 may be axially separated from ROP segment 280 by a distance or gap 188. Gap 188 may expand and/or contract (axially and/or radially) in response to the thermal and/or mechanical environment. In addition, gap 188 may expand and/or contract (axially and/or radially) as a result of thermal, mechanical, and pressure loading imparted in ROP segment 280, stator vane 72, and/or supporting structure during various transient and steady state engine operating conditions.

In various embodiments, gap 188 may be configured to house seal 102. Cooling air from secondary airflow S may tend to leak between ROP segment 280 and stator vane 72 in response to a pressure differential. Thus, a seal 102 may be coupled with and disposed between ROP segment 280 and stator vane 72 to prevent, reduce, and/or control leakage of secondary airflow S through gap 188 into core airflow path C. Seal 102 may form a partial seal or a complete seal between ROP segment 280 and stator vane 72, thereby reducing or eliminating leakage airflow L. Seal 102 may include a plurality of annular seals, as described herein, and may be placed between ROP segment 280 and stator vane 72 to limit leakage of secondary airflow S between ROP segment 280 and stator vane 72 and into core airflow path C.

In various embodiments, with reference to FIGS. 3 and 5, seal 102 may include a "W" seal (e.g. a seal having a "W"-shaped cross-section or that forms a "W" shape), a brush seal, a rope seal, a "C" seal (e.g. a seal having a "C"-shaped cross-section or that forms a "C" shape), a crush seal, a flap seal, a feather seal, or other suitable seal. Thus, seal 102 prevents or greatly reduces leakage airflow L passing through or around seal 102. Seal 102 may include a metal, such as titanium, titanium-based alloy, nickel, nickel-based alloy, aluminum, aluminum-based alloy, steel, or stainless steel, or other materials.

Figure 6A:
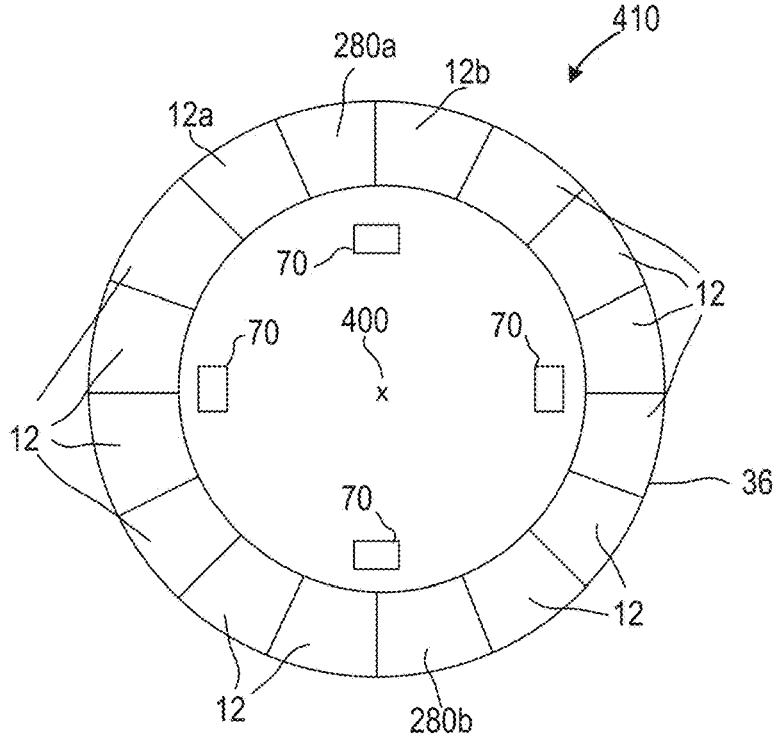
FIG. 6*a* illustrates a cross-section of a portion of a rotor overspeed protection assembly, in accordance with various embodiments.
Figure 6B:
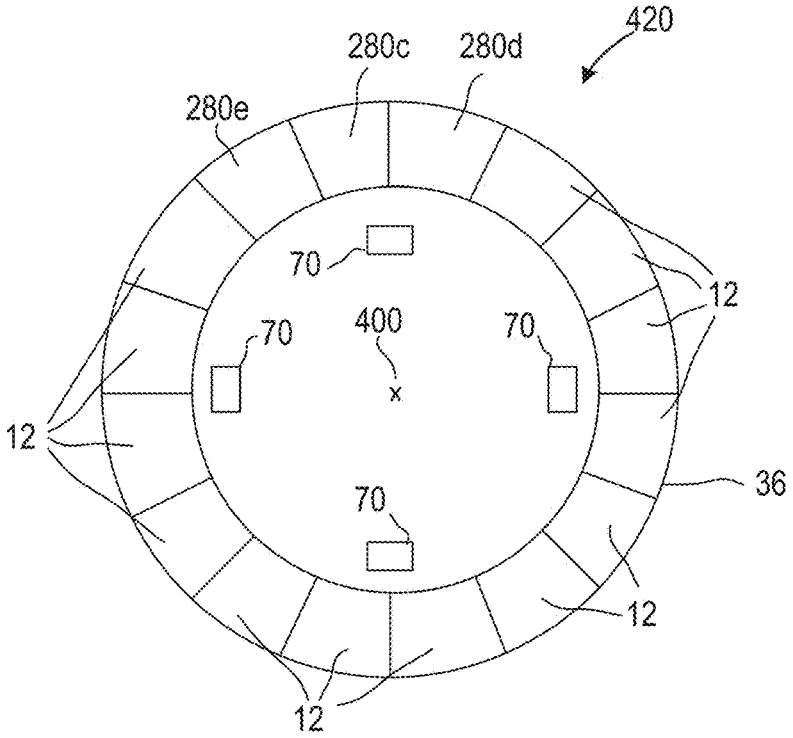
FIG. 6*b* illustrates a cross-section of a portion of a rotor overspeed protection assembly, in accordance with various embodiments.
Figure 6C:
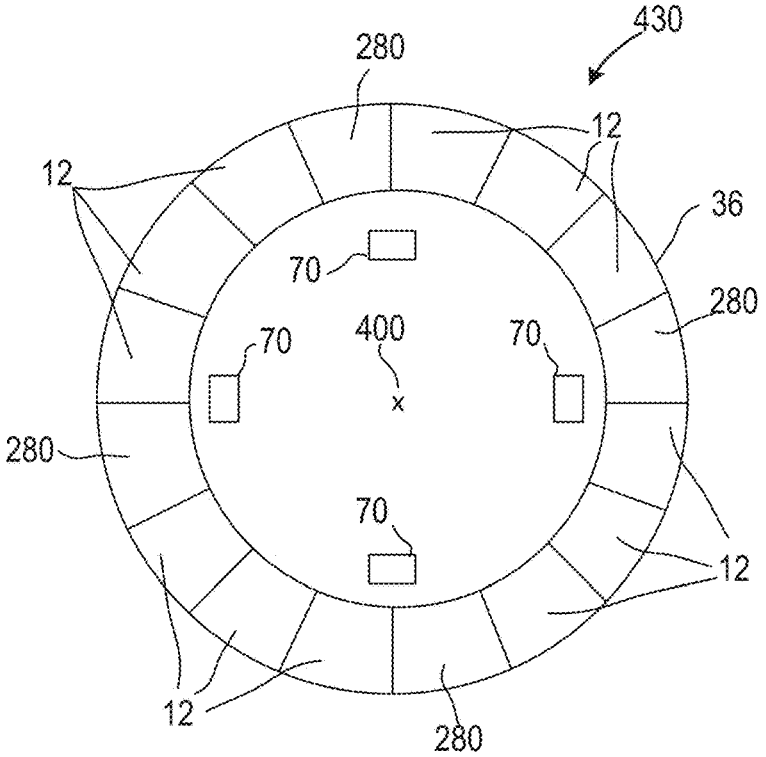
FIG. 6*c* illustrates a cross-section of a portion of a rotor overspeed protection assembly, in accordance with various embodiments.
Figure 6D:
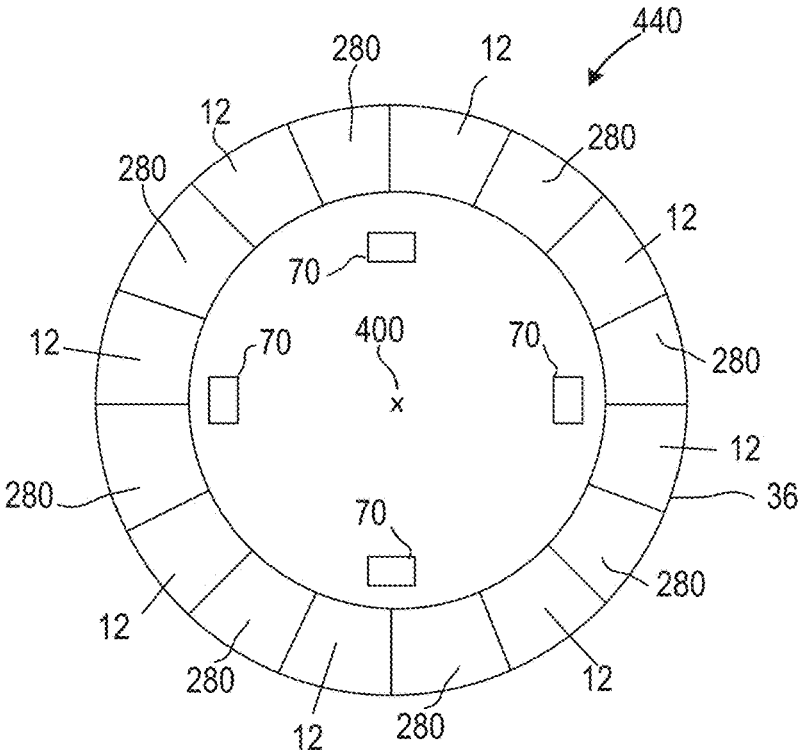
FIG. 6*d* illustrates a cross-section of a portion of a rotor overspeed protection assembly, in accordance with various embodiments.
Figure 6E:
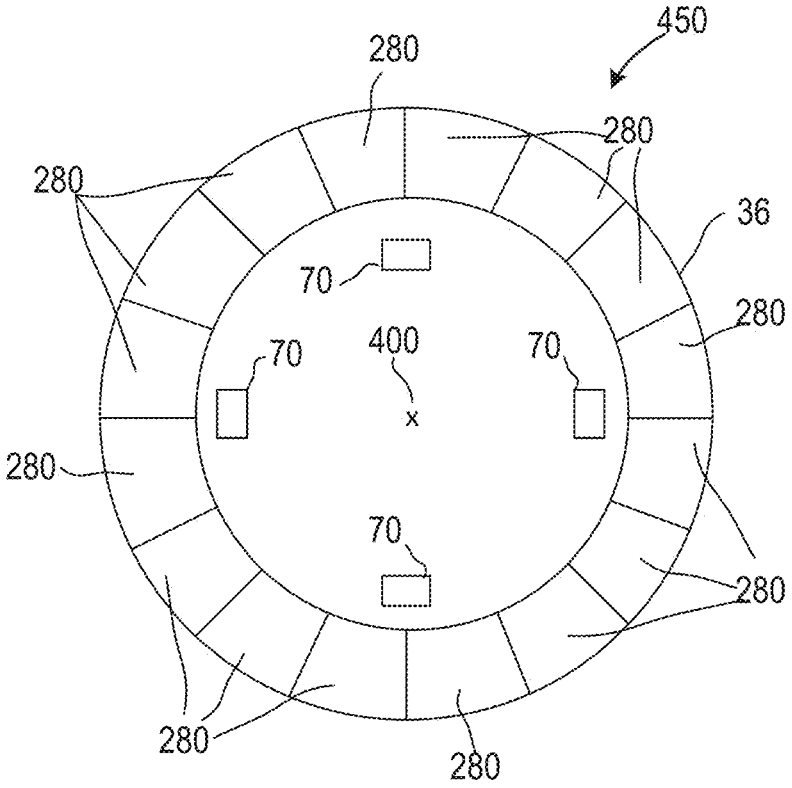
FIG. 6*e* illustrates a cross-section of a portion of a rotor overspeed protection assembly, in accordance with various embodiments.

Referring to FIG. 6*a* and FIG. 6*b*, a cross section axial view of BOAS assembly 410 is illustrated in accordance with various embodiments. Engine case structure 36 may define an engine centerline axis 400. BOAS assembly 410 may surround a plurality of rotor blades 70. Rotor blades 70 may rotate about engine centerline axis 400 with respect to outer structure 36. In various embodiments, BOAS assembly 410 may comprise first ROP segment 280*a*. BOAS assembly 410 may, for example, comprise ROP segment 280*a* coupled with and disposed between a first BOAS segment 12*a* and a second BOAS segment 12*b*. First BOAS segment 12*a* and second BOAS segment 12*b* may be identical to BOAS segment 12 in all aspects. In various embodiments, BOAS assembly 410 may comprise second ROP segment 280*b* disposed about 180 degrees from first ROP segment 280*a*. First ROP segment 280*a* and second ROP segment 280*b* may be identical to ROP segment 280 in all aspects.

BOAS assembly 10 may comprise a ROP segment 280 coupled with and disposed between a plurality of adjacent ROP segment 280. With reference to FIG. 6*b*, for example, within BOAS assembly 420, third ROP segment 280*c* may be coupled to fourth ROP segment 280*d*. Third ROP segment 280*c* may be coupled to fifth ROP segment 280*e*. Third ROP segment 280*c*, fourth ROP segment 280*d*, and fifth ROP segment 280*e* may be identical to ROP segment 280 in all aspects.

In various embodiments, a plurality of ROP segment 280 may be arranged in BOAS assembly 10 in a variety of configurations. In various embodiments, with reference to FIG. 6*c*, BOAS assembly 430 may comprise a plurality of ROP segments 280 disposed about 90 degrees apart about BOAS assembly 430. In various embodiments, with reference to FIG. 6*d*, BOAS assembly 440 may comprise an alternating arrangement of BOAS segments 12 and ROP segments 280 about BOAS assembly 440. In various embodiments, with reference to FIG. 6*e*, BOAS assembly 450 may be comprised entirely of ROP segments 280.

Figure 7:
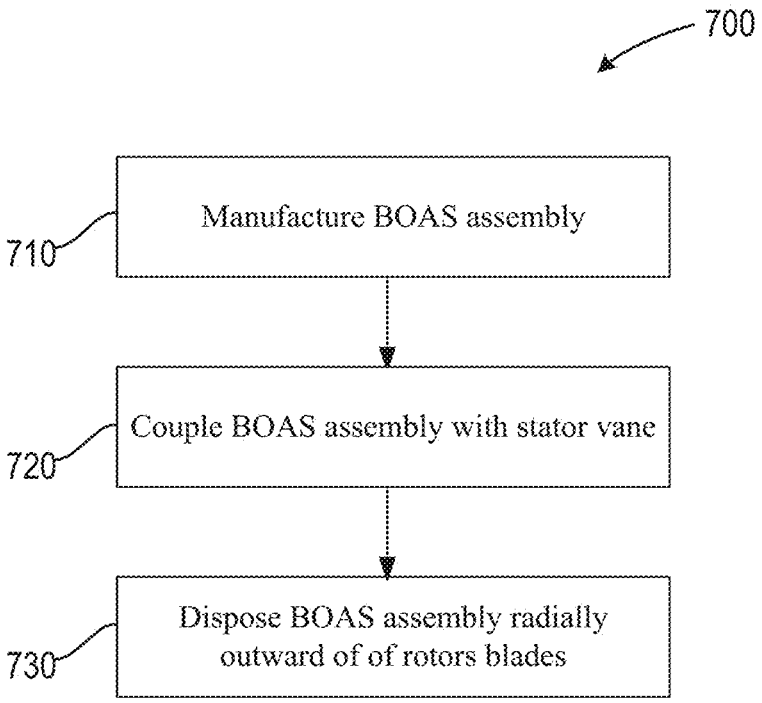
FIG. 7 illustrates a method of manufacturing a rotor overspeed protection assembly, in accordance with various embodiments.

In various embodiments, and with reference to FIG. 7, a method 700 of manufacturing a rotor overspeed protection (ROP) assembly 700 is provided. The method 700 may comprise manufacturing a blade outer air seal (BOAS) assembly wherein the BOAS assembly comprises a ROP segment (step 710). The method 700 may comprise coupling a stator vane with the ROP segment, wherein the ROP segment comprises a ROP flange extending in an axially aft direction from a main body of the ROP segment toward the stator vane, wherein the ROP flange is disposed radially inward of a stator flange of the stator vane (step 720). The method 700 may comprise disposing the BOAS assembly radially outward of a plurality of rotors blades (step 730). In various embodiments, the step of manufacturing the BOAS assembly may comprise coupling a first ROP segment to a first BOAS segment. In various embodiments, the manufacturing the BOAS assembly may comprise coupling a first ROP segment to a second ROP segment.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rotor overspeed protection (ROP) assembly of a gas turbine engine, comprising:

an annular blade outer air seal (BOAS) assembly comprising a first ROP segment; and a stator vane coupled with the BOAS assembly, the stator vane comprising a stator flange disposed about a forward edge portion of the stator vane, wherein the first ROP segment comprises a ROP flange extending in an axially aft direction from a main body of the first ROP segment toward the stator vane, wherein the ROP flange is disposed radially inward of the stator flange, and the BOAS assembly comprises a BOAS segment coupled with the first ROP segment, the BOAS segment comprising a BOAS flange extending in an axially aft direction from a main body of the BOAS segment toward the stator vane, wherein the BOAS flange is disposed radially outward of the stator flange of the stator vane.

2. The ROP assembly of claim 1, further comprising a second ROP segment, wherein the first ROP segment is coupled to the second ROP segment.

3. The ROP assembly of claim 2, wherein the second ROP segment is disposed 180 degrees from the first ROP segment about the BOAS assembly.

4. The ROP assembly of claim 1, wherein the BOAS assembly comprises a plurality of ROP segments and a plurality of BOAS segments, wherein the plurality of ROP segments and the plurality of BOAS segments alternate about the BOAS assembly, wherein the plurality of ROP segments comprises the first ROP segment.

5. The ROP assembly of claim 4, wherein each ROP segment of the plurality of ROP segments is similar to the first ROP segment.

6. The ROP assembly of claim 1, wherein the BOAS assembly comprises a plurality of ROP segments disposed 90 degrees apart about the BOAS assembly, wherein the plurality of ROP segments comprises the first ROP segment.

7. The ROP assembly of claim 1, wherein the stator flange is configured to contact the ROP flange in response to the stator vane rotating about a rear leg of the stator vane in an aft direction.

8. A gas turbine engine, comprising:

a turbine section including a stator vane or a compressor section including the stator vane; and a blade outer air seal (BOAS) assembly adjacent to the stator vane, wherein the BOAS assembly comprises a first rotor overspeed protection (ROP) segment, the first ROP segment comprising a ROP flange disposed about an aft portion of the first ROP segment, wherein the stator vane comprises a stator flange disposed about a forward edge portion of the stator vane, wherein the ROP flange is disposed radially inward of the stator flange, and the BOAS assembly comprises a BOAS segment coupled with the first ROP segment, the BOAS segment comprising a BOAS flange disposed about an aft portion of the BOAS segment, wherein the BOAS flange is disposed radially outward of the stator flange of the stator vane.

9. The gas turbine engine of claim 8, further comprising a second ROP segment, wherein the first ROP segment is coupled to the second ROP segment.

10. The gas turbine engine of claim 9, wherein the second ROP segment is disposed 180 degrees from the first ROP segment about the BOAS assembly.

11. The gas turbine engine of claim 8, wherein the BOAS assembly comprises a plurality of ROP segments and a plurality of BOAS segments, wherein the plurality of ROP segments and the plurality of BOAS segments alternate about the BOAS assembly, wherein the plurality of ROP segments comprises the first ROP segment.

12. The gas turbine engine of claim 11, wherein each ROP segment of the plurality of ROP segments is similar to the first ROP segment.

13. The gas turbine engine of claim 8, wherein the BOAS assembly comprises a plurality of ROP segments disposed 90 degrees apart about the BOAS assembly, wherein the plurality of ROP segments comprises the first ROP segment.

14. The gas turbine engine of claim 8, wherein the stator flange is configured to contact the ROP flange in response to the stator vane rotating about a rear leg of the stator vane in an aft direction.

15. The gas turbine engine of claim 8, wherein the stator vane is configured to pull the first ROP segment radially inward in response to the stator vane rotating about a rear leg of the stator vane in an aft direction.

16. A method of manufacturing a rotor overspeed protection (ROP) assembly, the method comprising:

manufacturing a blade outer air seal (BOAS) assembly, wherein the BOAS assembly comprises a first ROP segment;

coupling a stator vane with the first ROP segment, wherein the first ROP segment comprises a ROP flange extending in an axially aft direction from a main body of the first ROP segment toward the stator vane, wherein the ROP flange is disposed radially inward of a stator flange of the stator vane, and the BOAS assembly comprises a BOAS segment coupled with the first ROP segment, the BOAS segment comprising a BOAS flange disposed about an aft portion of the BOAS segment, wherein the BOAS flange is disposed radially outward of the stator flange of the stator vane; and coupling the BOAS assembly with an engine case structure of a gas turbine engine.

17. The method of claim 16, wherein the manufacturing of the BOAS assembly comprises coupling the first ROP segment to the BOAS segment.

18. The method of claim 16, wherein the BOAS assembly further comprises a second ROP segment, wherein the manufacturing of the BOAS assembly comprises coupling the first ROP segment to the second ROP segment.

* * * * *